US005251687A

United States Patent [19]

Ashok et al.

[11] Patent Number: 5,251,687

[45] Date of Patent: Oct. 12, 1993

[54] CASTING OF METAL STRIP

[75] Inventors: Sankaranarayanan Ashok, Bethany; Harvey P. Cheskis, North Haven, both of Conn.

[73] Assignee: Olin Corporation, Cheshire, Conn.

[21] Appl. No.: 528

[22] Filed: Jan. 4, 1993

Related U.S. Application Data

[63] Continuation of Ser. No. 753,538, Sep. 3, 1991, abandoned.

[51] Int. Cl.[5] ..... B22D 11/06; B22D 11/124

[52] U.S. Cl. ..... 164/479; 164/429; 164/486

[58] Field of Search ..... 164/423, 463, 429, 479, 164/444, 486

[56] References Cited

U.S. PATENT DOCUMENTS 3,623,535 11/1971 Lenaeus ..... 164/433
4,030,537 6/1977 Ward ..... 164/433

FOREIGN PATENT DOCUMENTS 59-150646 8/1984 Japan ..... 164/479
62-176649 8/1987 Japan ..... 164/479

*Primary Examiner*—Kuang Y. Lin
*Attorney, Agent, or Firm*—H. Samuel Kieser; Bruce E. Burdick

[57] ABSTRACT

A method of casting metal wherein molten metal is deposited on a moving planar substrate to form a strip thereon. The strip is removed from the moving substrate onto an open mesh support prior to the strip becoming completely solidified throughout its thickness. Ideally, the strip is removed as soon as it forms a solidified shell on its bottom which is thick enough not to fracture under the weight of the remaining molten metal. This arrangement overcomes the problem of cooling the bottom surface of the cast metal due to an air gap forming between a solid supporting substrate and the cast metal.

6 Claims, 2 Drawing Sheets

CASTING OF METAL STRIP

This application is a continuation of application Ser. No. 07/753,538 filed Sep. 3, 1991, now abandoned.

BACKGROUND OF THE INVENTION

1. Field of the Invention

This invention relates generally to the casting of metal, and more particularly, to an improved method and apparatus for the casting of metal strip or sheet in a continuous operation.

2. Background Information

The metals industry has been developing processes and apparatus for producing an as-cast product that needs little or no additional processing such as hot rolling to reduce it to strip form. One such process that has arisen as a result of this development is the single belt casting process. In this process, molten metal is caused to flow onto a moving horizontal surface in the form of a continuous belt whereupon it solidifies as it moves along with the belt. The elongated solid strip of metal is removed from the continuous belt for further processing as desired.

One major disadvantage of this process is the low cooling rate of the molten metal on the belt. As the metal solidifies upon the belt, an air gap forms between the belt and the strip. These air gaps are poor thermal conductors and result in non-uniform heat transfer from the metal. This leads to poor product quality such as cracking and porosity in the metal.

SUMMARY OF THE INVENTION

It is an object of the present invention to provide an improved casting system wherein molten metal is cast into strip in which the cooling rate of the casting is improved.

These and other objects of the present invention may be achieved through a process which comprises providing a source of molten metal, passing a moving substrate underneath said source of molten metal having a planar portion thereof passing through a position at which a deposit of molten metal is placed on said substrate and forms a strip thereon. The strip is removed from the moving belt onto an open mesh support prior to the strip becoming completely solidified throughout its thickness upon which is supported until it fully solidifies.

An apparatus for practicing the present invention includes a source of molten metal, a moving substrate having a planar portion mounted for movement through a position at which a deposit of molten metal is placed on said substrate and forms a strip thereon, and an open mesh support upon which the strip is passed prior to becoming completely solidified on said moving substrate.

BRIEF DESCRIPTION OF THE DRAWINGS

The present invention may be more readily understood by reference to the following detailed description and to the accompanying drawings in which.

DETAILED DESCRIPTION

The present invention is directed to the casting of strip or sheet from molten metal. By strip or sheet is meant metal having a rectangular cross-section of substantially greater width than thickness and in which the thickness is between about $\frac{1}{8}$ to about $\frac{3}{4}$ inch and preferably between about $\frac{1}{4}$ to about $\frac{1}{2}$ inch. While the invention may be applicable to many metals, it is particularly applicable to the casting of copper or copper alloys.

Figure 1:
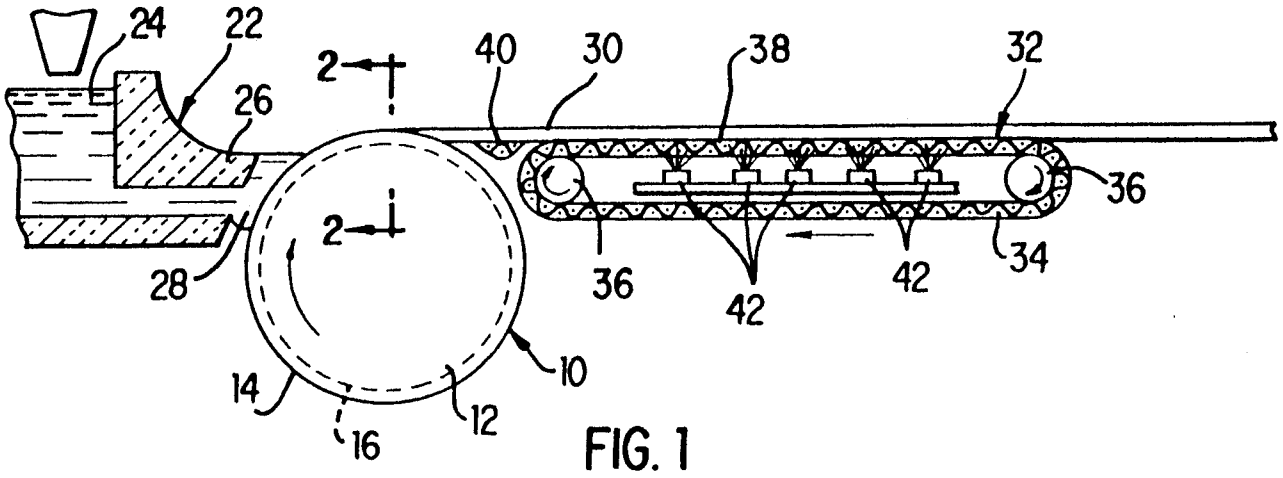
FIG. 1 is a schematic elevational view, partially in section, of one embodiment of a casting apparatus incorporating the present invention.
Figure 2:
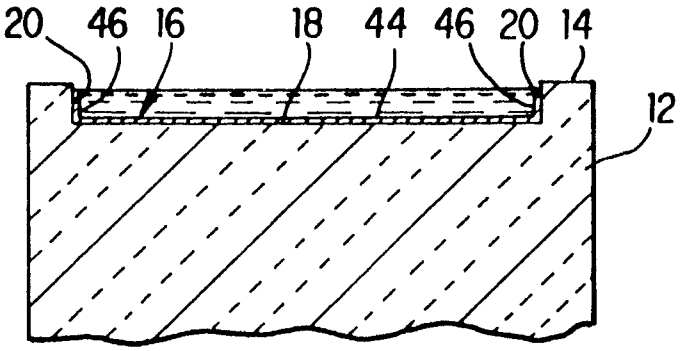
FIG. 2 is a sectional view taken along the lines 2—2 of FIG. 1.

Referring now to the drawings in detail, and in Particular FIGS. 1 and 2, there is shown schematically one embodiment of a casting system which may be used to practice the present invention. The system includes a moving substrate 10 in the form of a casting wheel or drum 12 having a cylindrical outer surface 14. A groove 16 extends about the outer surface 14 and is defined by a base 18 and opposed side edges 20. The wheel or drum 12 is rotatable about its axis in the direction indicated by the arrow in FIG. 1 by means of a suitable mechanism (not shown) such as a motor.

A tundish 22 is supported in close proximity to the casting wheel or drum 12 and contains a supply of molten metal 24. The tundish 22 has an outlet or nozzle 26 at which a meniscus 28 of molten metal 24 is formed which is maintained in contact with the outer surface 14 of the wheel or drum 12. The tundish 22 is supported in fixed relationship to the wheel or drum 12 by a suitable frame structure (not shown).

As the wheel or drum 12 is rotated, the outer surface 14 thereof passes by the nozzle or outlet 26 of the tundish 22, and contacts the meniscus 28 the molten metal 24. The molten metal 24 substantially wets the outer surface of the drum or wheel 12 and is dragged along with it forming a deposit thereon positioned within the groove 16. The metal continues moving with the drum or wheel 12 until it is withdrawn tangentially therefrom as a strip 30 at the vertical apex.

The tundish 22 may be constructed from a high strength, thermally-insulating material such as a cast ceramic material or a rigid metal frame structure lined with suitable refractory material to minimize heat loss from the molten metal 24 contained within the tundish 22 during operation.

The wheel or drum 12 may be formed of any suitable material such as metal which will not melt or fracture under the operating conditions. Suitable metals include steel or copper or copper alloys. Other materials which may be used include graphite and ceramic material such as boron nitride.

A mesh supporting surface 32 for the strip 30 is provided downstream of the drum or wheel 12 as shown. This supporting surface 32 is of a filter-type material such as expanded mesh through which air and water can pass. Ideally, this supporting surface 32 is in the form of a moveable continuous belt 34 mounted on spaced rollers 36 which moves in the direction as indicated by the arrows in FIG. 1 and which provides an upper run 38. Alternatively, the surface 32 may be in the form of a static table and the strip 30 moved across the table by driven pinch rollers positioned downstream of the upper surface 50. The expanded mesh may be fabricated from steel, preferably stainless steel.

The upper run 38 is positioned in a plane tangential with the vertical apex of the drum or wheel 12. A static support 40, coplanar with the upper surface of the upper run 38 may be provided between the wheel or drum 12 and the upstream end of the upper run 38 of the belt 34 to close any gap therebetween. Cooling sprays 42 are provided underneath the upper run 38 of the supporting mesh material 32 to spray cooling fluid such as water through the mesh belt 34 against the bottom surface of the strip 30.

In operation, the molten metal flowing from the outlet 26 of the tundish 22 forms a meniscus 28 against the rotating wheel or drum 12. Molten metal from the meniscus 28 is dragged along with the rotating drum and is positioned within the groove 16. The length of travel of metal on the drum before the strip 30 is removed therefrom at the vertical crest and is set so that the strip 30 of the cast metal will pass onto the mesh surface 32 prior to the strip 30 becoming completely solidified throughout its cross-section. Ideally, the strip 30 is caused to pass onto the open mesh 32 as soon as a solidified shell forms on the bottom surface 44 and side surfaces 46 thereof which is thick enough so as not to fracture under the weight of the remaining molten metal.

Figure 3:
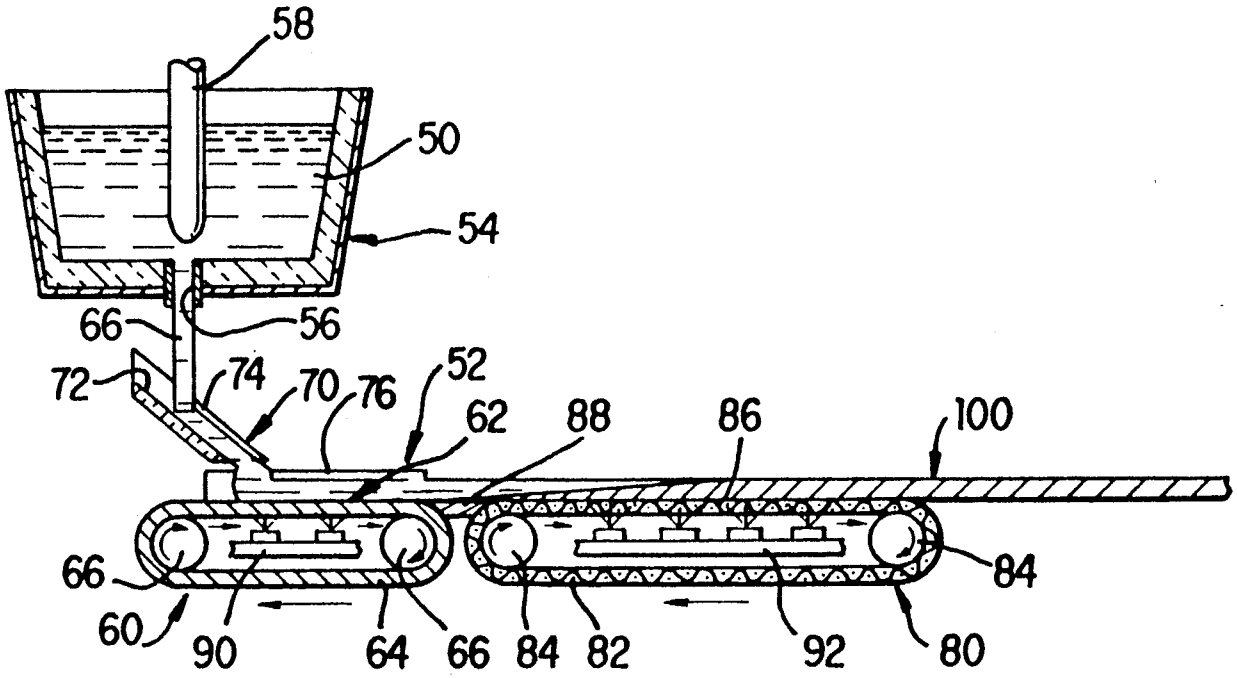
FIG. 3 is a schematic elevational view, partially in section, of a second embodiment of a casting apparatus incorporating the present invention.

Referring to FIG. 3, a second embodiment is shown schematically of a casting system which incorporates the present invention. Molten metal 50 may be supplied to the casting apparatus 52 from a refractory lined vessel 54 having a discharge opening 56 therein. A plunger 58 is provided in the interior of the vessel 54 which is associated with the discharge opening 56 to control the flow of molten metal from the vessel 54. For this purpose, the plunger 58 may be vertically reciprocated by any suitable mechanism (not shown).

A continuous moving belt arrangement 60 having an upper planar horizontal run 62 is mounted beneath the discharge opening 56 of the vessel 54. The belt arrangement 60 includes a flexible belt 64 entrained about and extending between horizontally spaced rollers 66. One of the rollers 66 may be connected to a suitable drive means (not shown) to drive the belt 64 at the proper speed in the direction indicated by the arrow.

The belt 64 may be made of a solid material such as steel, and preferably a low carbon steel, although other materials may be used so long as the material will not melt through when contacted by the molten metal being cast.

Feeding means such as a refractory lined tundish 70 may be provided between the vessel 54 and the continuous belt arrangement 60 in a position to be contacted by the stream 66 of the molten metal issuing from the outlet 56 of the vessel 54. The tundish 70 may include a refractory lined trough-like member having a generally flat inclined bottom surface 72 with spaced vertically extending side edges 74. The tundish 70 is inclined as shown in FIG. 1 such that its planar bottom surface 72 is inclined downwardly toward the downstream end of the upper run 62 of the continuous belt 64. Spaced side dams 76 may be provided which may be either moveable with the belt or a static structure along each edge of the upper run 52 of the belt 54 to contain the molten metal in a transverse direction to the movement of the belt 54.

A supporting surface 80 is provided downstream of the upper run 62 of the moving belt 60. This supporting surface 80 is similar to the supporting surface 32 of the previous embodiment shown in FIG. 1 and is of a filter-type material such as expanded mesh through which air and water can pass. This supporting surface 80 may also be in the form of a continuous belt 82 mounted on spaced rollers 84 and which provides an upper run 86 moving in the direction as indicated by the arrows in FIG. 1. As in the case of the previous embodiment, the surface 80 may alternatively be in the form of a static table and the strip moved across the table by driven pinch rollers positioned downstream of the upper surface 50. The expanded mesh may be fabricated from steel, and preferably stainless steel.

The upper run 86 is coplanar with the upper run 62 of the belt 64. A static support surface 88 coplanar with the upper surfaces of the upper runs 62 and 86 may be provided between the downstream end of the upper run 62 of belt 64 and the upstream end of the upper run 86 of the belt 82 to close the gap therebetween.

Cooling sprays 90 and 92 are provided underneath the upper run 62 of the moving belt 64 and underneath the upper run 86 of the supporting mesh material 86 respectively to cool the bottom surface of the strip.

In the operation of this embodiment, the molten metal 66 is caused to flow from the tundish 70 onto the upper run 62 of the moving belt 66. The length of this upper run 62 upon which the metal is in contact therewith (contact length) is set so that the strip 100 of the cast metal will pass onto the mesh support 80 prior to the strip 100 becoming completely solidified throughout its cross-section. Ideally, the strip 100 is caused to pass onto the open mesh support 80 as soon as a solidified shell forms on the bottom surface thereof which is thick enough so as not to fracture under the weight of the remaining molten metal. While the contact length of the upper run of the moving belt will vary depending upon the effective cooling provided as well as the alloy being cast, in the case of copper alloys with bottom cooling, the upper run should be in the range of about 4 to 8 inches and preferably about 6 inches.

By virtue of the above-described arrangement, the cooling rate of the casting is improved by virtue of the fact that the air gap which normally forms between a solid substrate and a strip is eliminated.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A process for casting metal comprising:

a. providing a source of molten metal, b. passing a moving substrate through a position relative to said source of metal to receive a molten metal strip deposit thereon, c. depositing a stream of molten metal from the source as a molten metal strip deposit onto the moving substrate at the position, d. cooling a bottom and side of the molten strip deposit, while on the moving substrate, sufficiently to preliminarily solidify just the outer portion of the bottom and side to form a tray like shell of enough strength to contain the molten remainder of the molten strip deposit without side support and without full bottom support, and e. removing said strip from said moving substrate, after the preliminary solidification, f. transferring the partially solidified strip onto an open mesh moving support while the strip has a solidified lower surface and a liquid upper surface, and g. supporting the partially solidified strip on the moving mesh support while cooling the strip to further solidification, whereby the size of the moving substrate can be minimized to make the casting process more economical without sacrificing metal quality.

2. The process of claim 1 further comprising applying cooling to the underside of the strip positioned against said mesh.

3. The process of claim 1 wherein said strip is removed from said moving belt immediately after it forms a solidified shell on its underside thick enough not to fracture under the weight of the remaining molten metal but prior to solidification of the upper surface of the strip.

4. The process of claim 1 wherein said moving substrate is a rotating wheel.

5. The process of claim 1 wherein said moving substrate is an endless belt.

6. The process of claim 1 wherein said open mesh support is a continuous belt.

* * * * *